US005531590A

United States Patent [19]

Browning

[11] Patent Number: 5,531,590

[45] Date of Patent: Jul. 2, 1996

[54] SHOCK-STABILIZED SUPERSONIC FLAME-JET METHOD AND APPARATUS

[75] Inventor: James A. Browning, Hanover, N.H.

[73] Assignee: DRACO, Hanover, N.H.

[21] Appl. No.: 414,780

[22] Filed: Mar. 30, 1995

[51] Int. Cl.[6] ..... F23C 5/00

[52] U.S. Cl. ..... 431/8; 431/353; 239/79; 239/85; 427/446

[58] Field of Search ..... 431/353, 8, 2; 239/79, 85; 427/446

[56] References Cited

U.S. PATENT DOCUMENTS

| | | | |
|---|---|---|---|
| 2,510,482 | 6/1950 | Scharbau et al. | 431/353 |
| 2,714,563 | 8/1955 | Poorman et al. | 239/85 |
| 2,861,900 | 11/1958 | Smith et al. | 427/446 |
| 3,190,560 | 6/1965 | Schilling et al. | 239/85 |
| 4,004,735 | 1/1977 | Zverev | 239/79 |
| 4,165,364 | 8/1979 | Dollinger et al. | 431/8 |
| 4,836,447 | 6/1989 | Browning | 239/85 |

*Primary Examiner*—Carroll B. Dority

*Attorney, Agent, or Firm*—Sughrue, Mion, Zinn, Macpeak & Seas

[57] ABSTRACT

A supersonic flame jet device includes a body having an entry portion of relatively small cross-sectional area, an expanding supersonic nozzle section and a cylindrical duct of extended length connected in series with each other. In using the device, an oxidant at high pressure is introduced into the entry passage wherein the flow is increased to sonic velocity. The sonic velocity flow of oxidant is then introduced into the passage of expanding cross-section in the direction of the gas flow while introducing a fuel to be burned into the flow of the oxidant. The velocity of flow of the oxidant or the oxidant and the fuel is then increased to supersonic velocity prior to entry into the extended duct of constant cross-sectional area where a shock is produced to stabilize flame reactions along the extended duct length whereby a supersonic flame jet will exit the extended duct.

9 Claims, 3 Drawing Sheets

SHOCK-STABILIZED SUPERSONIC FLAME-JET METHOD AND APPARATUS

BACKGROUND OF THE INVENTION

The present invention is directed to a shock-stabilized duct-mode device for creating a high temperature and high velocity flame jet suitable for spraying high melting point materials.

Flame jets are utilized for general heating purposes as well as specific uses including cutting and drilling of granite and the thermal spraying of metallic or other materials to form coatings on a base material. Where high heat transfer rates and/or supersonic velocity flame jets are required, certain types of flame-producing device have been available. These devices reduce to two basic modes of operation—the chamber-stabilized mode and the duct-stabilized mode.

The earliest description of both the duct and chamber modes is given in the G.H. Smith et al. patent (U.S. Pat. No. 2,861,900). FIG. 1*a* of the present application is a simplified sketch of a "duct stabilized" device of the type described by Smith et al. The burner 10 consists of two bores of different diameter. Oxygen enters the burner 10 through a relatively small diameter bore 12. Fuel, entering bore 12 through passage 13, mixes with the oxygen flow and the combined flow is discharged from bore 12 into the larger duct 11. The oxy-fuel mixture is ignited upon its entry to duct 11 with nearly complete combustion occurring prior to exit of the flame products from duct 11. Supersonic flame 14 extends as a flame-jet beyond duct 11 and is characterized by shock diamonds 16. Metallic powder is injected through duct 16.

In this conventional "duct mode" geometry (FIG. 1*a*) the gas flow is "choked". That is, the walls of duct 11 prevent the rapid expansion of the gas required to reach supersonic velocity. Supersonic velocity only occurs beyond the exit of duct 11 in the open atmosphere. In "choked flow" the gas pressure over the entire duct length remains above atmosphere (see FIG. 1*b*). In "choked flow" the exit gas velocity has reached sonic velocity (see Fe. 1*c*) which for the hot products of combustion is about 3,000 feet per second.

FIG. 3*a* of the present application is a simplified sketch of a "chamber-stabilized mode" of the type described by Smith et al. The "chamber stebilized mode" of FIG. 3*a* utilizes a relatively large volume chamber 31 to stabilize and contain the combustion reactions. Oxygen and fuel are fed under pressure into chamber 31 in burner 30 through ports 32 and 33. A very small nozzle throat 34 with an expanding conical bore 35 expands the hot gas exiting from chamber 31 to extremely high velocity. For an inlet oxygen pressure of 500 psig (FIGS. 1*b* and 1*c*) the exit gas velocity is over 8,000 ft/sec. Where high particle impact velocities are required for thermal spray process optimization, the "chamber mode" is superior to the "duct mode". However, as the oxygen pressure is raised to produce favorable particle velocities, unacceptable heat losses to the cooling water (not shown) occur. Higher melting point materials such as aluminum oxide remain solid and will not form a coating.

The "duct mode", with a much smaller "wetted surface" available for heat transfer from the flame to the cooling water (not shown) has much higher flame-jet temperatures than for the "chamber mode". Thus, even though particle velocities are much lower, it may have to be selected for certain types of thermal spraying.

Another form of duct-stabilized device for limiting particle build-up on the inner duct walls is disclosed in the Browning patent (U.S. Pat. No. 4,836,447). In this patent, the expanding section 12 acts as a diffuser and at no point along the path of the gas stream is the flow supersonic.

SUMMARY OF THE INVENTION

The present invention is an improvement in the duct-stabilized mode by providing a change in the means for continuously initiating combustion in an oxygen-fuel mixture and keeping stable flame reactions within a high-velocity flow stream of these reactants.

The present invention provides a new and improved flame jet apparatus comprised of a body having an entry passage of relatively small cross-sectional area and an expanding supersonic nozzle section 23 connected to a cylindrical duct of extended length.

The present invention also provides a new and improved method for producing a supersonic jet stream of high temperature using the foregoing apparatus comprising introducing a mixed flow of oxidizer gas and fuel to flow at supersonic speed through an initial portion of an extended duct and causing a shock to form within the duct forcing a sufficient change in pressure, temperature, velocity and turbulence to initiate and/or maintain combustion reactions downstream of said shock thereby extending the combustion through the remaining duct length and beyond the duct exit in the form of a supersonic jet stream.

The foregoing and other objects, features and advantages of the invention will be apparent from the following more particular description of a preferred embodiment of the invention as illustrated in the accompanying drawings.

DETAILED DESCRIPTION OF THE INVENTION

Figure 1A:
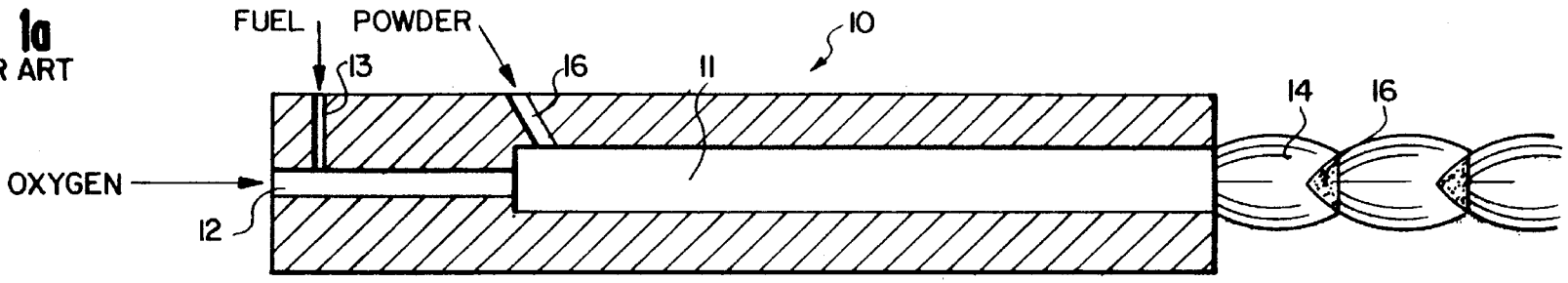
FIG. 1a PRIOR ART
FIG. 1*a* is a schematic cross-sectional view of a conventional device for operating in the "duct mode".
Figure 2A:
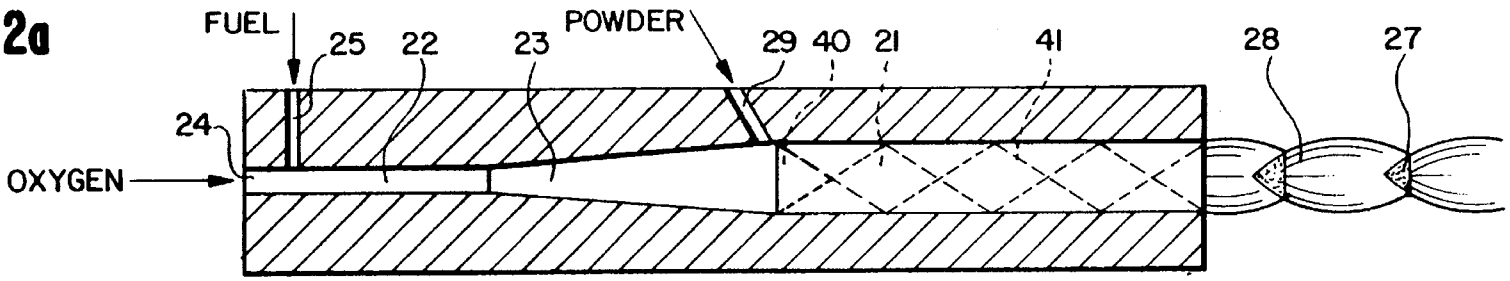
FIG. 2*a* is a schematic cross-sectional view of the device of this invention for operating in the shock-stabilized duct mode.

In an effort to keep particle velocities at relatively high values, yet reduce thermal heat losses to the coolant, the "shock-stabilized duct mode" of FIG. 2*a* gives excellent results. The conventional "duct mode" of FIG. 1*a* cannot operate above an inlet oxygen pressure of about 150 psig. Flame reactions are not stabilized satisfactorily and the flame is, simply, "blown-out". Although gas temperatures are satisfactorily high, flame-jet velocities are much too low.

Figure 2B:
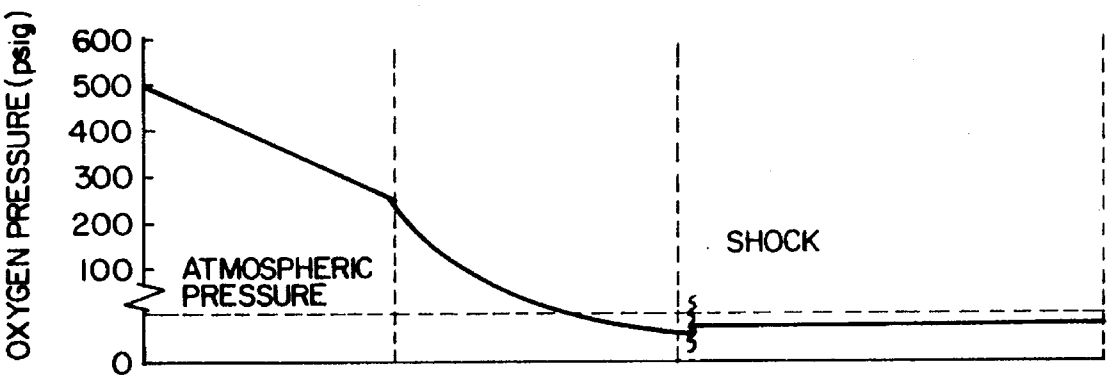
FIG. 2*b* is a plot of the pressure drop of the gas in its passage through the device of FIG. 2*a*.
Figure 2C:
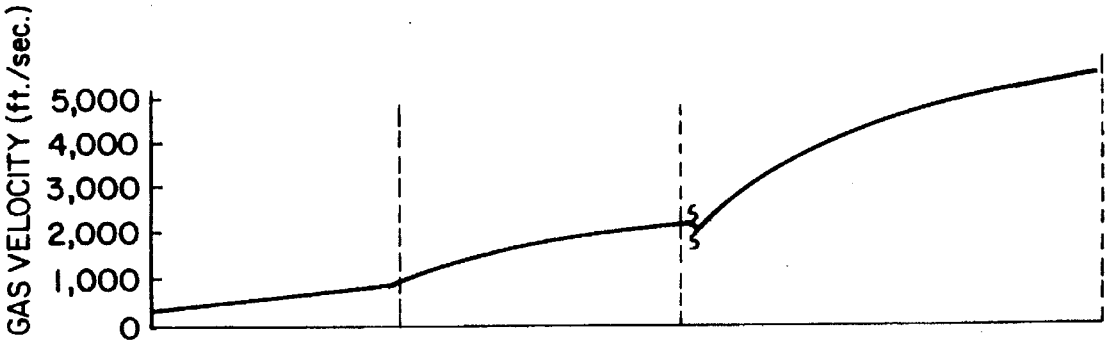
FIG. 2*c* is a plot of the gas velocity in the flow passing through the device of FIG. 2*a*.

In FIG. 2*a*, burner 20 consists of a body piece containing an entry passage 22 of relatively small cross-sectional area and an expanding supersonic nozzle section 23 connected to a cylindrical duct 21 of extended length which has larger cross-sectional area than the passage 22. Oxygen and fuel introduced to passage 22 through ports 24 and 25 mix together and reach sonic velocity prior to entering nozzle expansion 23. The powder to be coated on a substrate is injected through port 29. At an oxygen inlet pressure of 500 psig (FIGS. 2*b* and 2*c*) the gas pressure may become sub-atmospheric by the end of supersonic expansion with a cold gas velocity of over 2,000 ft/sec. The discontinuity formed at the wall where the expanding section 23 meets the cylindrical duct 21 forms a weak shock 40. Small pressure increases occur almost instantly across the shock front and the gas velocity is somewhat reduced. Beyond the shock 40 the reactive gases (oxygen and fuel) are nearly fully burned in duct 21. Although it is possible that a small amount of combustion may have occurred upstream of shock 40, fully stable combustion with its efficient heat release could not have occurred in the absence of the shock 40. Additional shocks 41 occur in duct 21 and shock diamonds 27 occur in the flame jet 28.

Figure 3A:
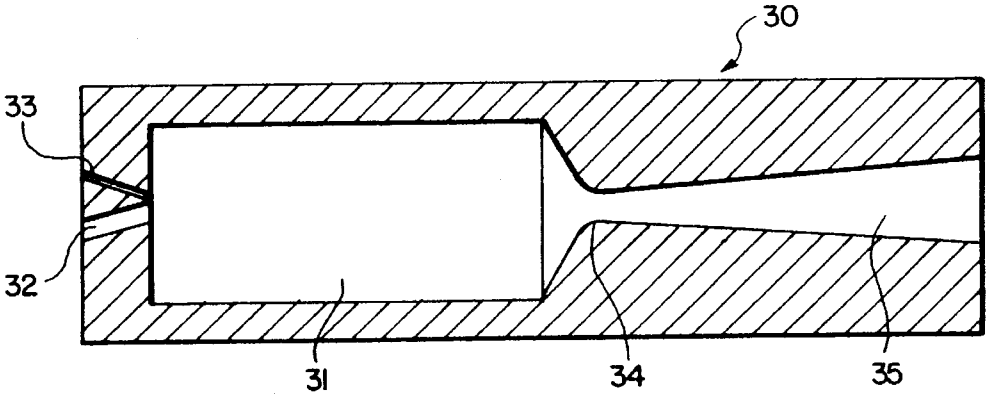
FIG. 3a PRIOR ART
FIG. 3 is a schematic cross-sectional view of a conventional device for operating in the chamber stabilized mode.
Figure 3B:
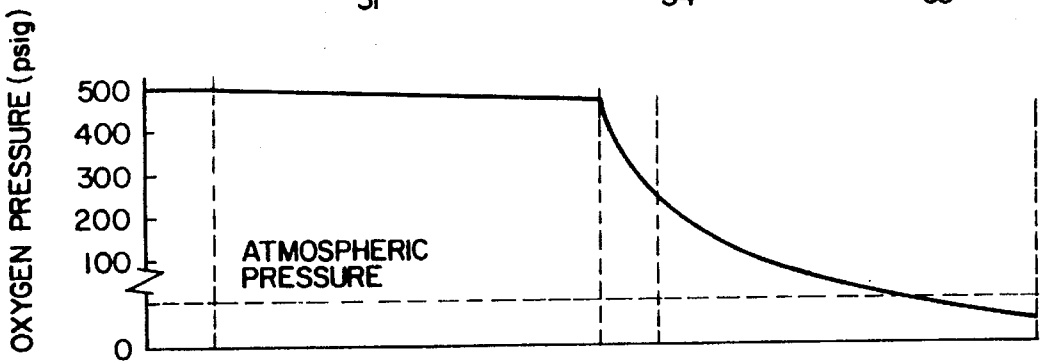
FIG. 3b PRIOR ART
Figure 3C:
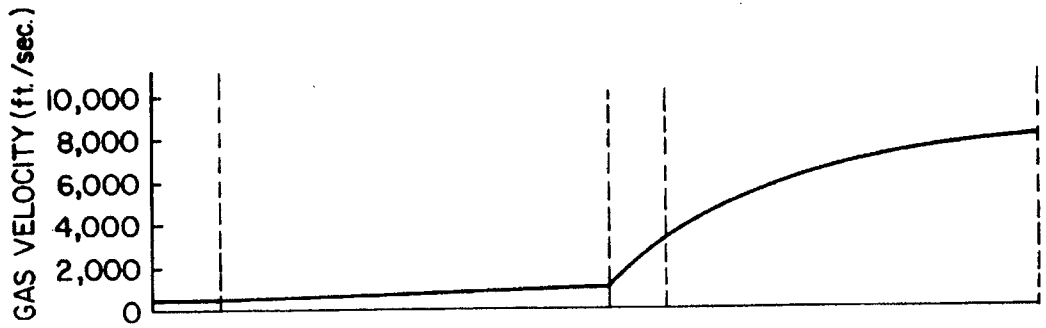
FIG. 3c PRIOR ART

The shock-stabilized duct mode can create jet velocities about double conventional duct mode devices. Jet temperatures remain high allowing ceramic spraying. This device compliments a chamber mode device where high melting point materials must be sprayed. The geometry is much simpler and length of operation is greatly extended as the small nozzle throat 34 of the chamber mode (FIG. 3*a*) is eliminated. At high pressure, using pure oxygen as the oxidizer, throat life is limited by intense heat transfer requirements at the throat.

With respect to the conventional duct mode device, both the pressure and velocity plots (FIGS. 1*b* and 1*c*) of the duct mode device are distinctly different from those of the shock-stabilized duct mode of the present invention. Smooth transitions exist for the duct mode. The shock in the device according to the present invention causes nearly instantaneous changes in both pressure and velocity.

In an earlier program to develop a duct-stabilized device to limit particle build-up on the inner duct walls, a geometry was developed which has proven quite successful (see U.S. Pat. No. 4,836,447). This geometry is very much like that used for shock-stabilization of the present invention. However, the expanding section 12 (FIG. 1 of the '447 patent) acts as a diffuser. At no point along the path of the base stream is the flow supersonic. In the design of the shock stabilized duct mode unit of the present invention, the area ratio of hole 21 to hole 22 should be the correct ratio for the inlet oxygen pressure, the oxygen pressure should be above about 200 psig, and provision for shock attachment to the duct wall should be provided. The ratio of the cross-sectional areas of the duct-to-small passage is greater than 4 to 1.

While an oxy-fuel unit has been disclosed in connection with the shock phenomenon of the invention, other oxidizers can be used. Where an expanding supersonic nozzle section is used (23 of FIG. 2*a*) other geometries may exist. The problem of supersonic flow within a combusting system is extremely complex. The values of pressure and velocity particularly their change along the flow path, are only best estimates.

Figure 1B:
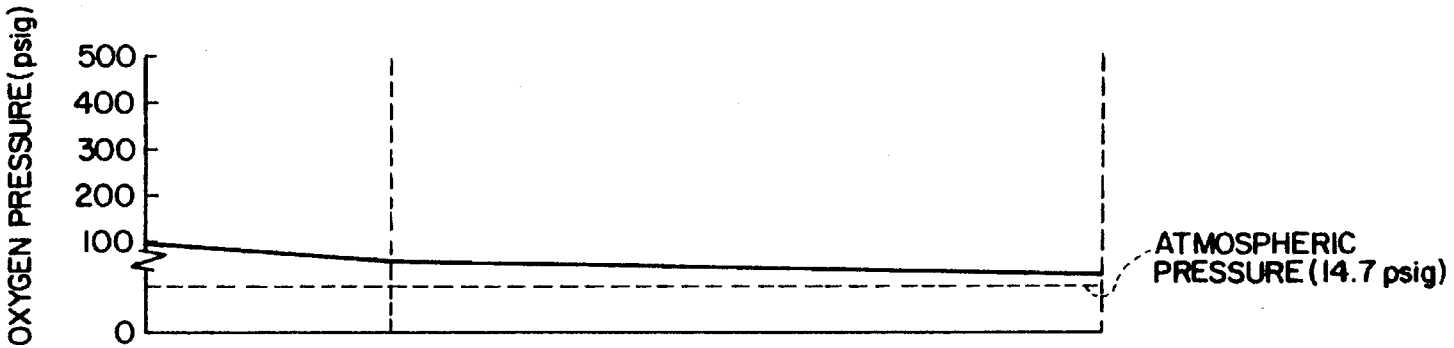
FIG. 1b PRIOR ART
FIG. 1*b* is a plot of the pressure drop of the gas in its passage through the device of FIG. 1*a*.
Figure 1C:
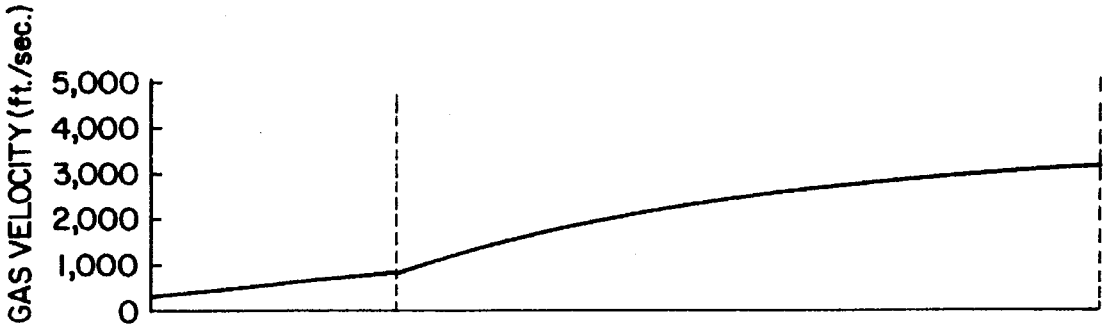
FIG. 1c PRIOR ART
FIG. 1*c* is a plot of the gas velocity in the flow passing through the device of FIG. 1*a*.

In FIG. 1*a* the exiting jet 15 expands immediately beyond the exit showing that the flow pressure just before release from the duct is above atmospheric. This is under-expanded flow. In FIG. 2*a*, the jet 28 contracts showing an over-expansion of the gas within the duct.

While the invention has been particularly shown and described with reference to preferred embodiments thereof, it will be understood by those in the art that the foregoing and other changes in form and details may be made therein without departing from the spirit and scope of the invention.

What is claimed is:

1. A method for producing a supersonic jet stream of high temperature extending beyond the exit of an internal burner, said method comprising introducing a mixed flow of oxidizer gas and fuel to flow at supersonic speed through an initial portion of an extended duct, causing a shock to form within said duct forcing a sufficient change in pressure, temperature, velocity, and turbulence of the gas flow to initiate and/or maintain combustion reactions downstream of said shock, said combustion extending through the remaining duct length, with said gas flow extending beyond the duct exit in the form of a supersonic jet stream.

2. A method for producing a supersonic jet stream of high temperature products of combustion extending beyond the exit of an internal burner of the duct type, said method comprising the introduction of an oxidant at high pressure to a first passage of relatively small cross-sectional area, increasing the velocity of this gas to sonic velocity flow within the length of said relatively small passage, introducing said sonic velocity flow of said oxidant to a passage of expanding cross-section in the direction of gas flow, introducing a fuel to be burned into said flow of said oxidant, further increasing the velocity of flow of said oxidant or said oxidant and fuel to supersonic velocity prior to entry to a duct of essentially constant cross-sectioned area selecting a duct diameter which, in combination with the geometry of said expanding passage and the gas flow properties produces a shock region in the vicinity of the entrance to said duct, said shock acting to initiate or stabilize flame reactions along the extended duct length.

3. A method as set forth in claim 1, wherein the ratio of the cross-sectional areas of the duct-to-small passage is greater than 4 to 1.

4. A method as set forth in claim 1, wherein the flow of said gas downstream of said shock remains supersonic during flow through said extended duct.

5. A method as set forth in claim 1, wherein the pressure of said gas downstream of said shock remains sub-atmospheric during flow through said extended duct.

6. A method as set forth in claim 2, wherein the ratio of the cross-sectional areas of the duct-to-small passage is greater than 4 to 1.

7. A method as set forth in claim 2, wherein the flow of said gas downstream of said shock remains supersonic during flow through said extended duct.

8. A method as set forth in claim 2, wherein the pressure of said gas downstream of said shock remains sub-atmospheric during flow through said extended duct.

9. A flame jet apparatus comprising a body having an entry passage of relatively small cross-sectional area, an expanding supersonic nozzle passage in communication with said entry passage and an extended cylindrical duct in communication with said nozzle passage, wherein the ratio of cross-sectional areas of the extended duct to the entry passage is greater than 4 to 1, and means supplying a mixture of fuel and oxidizer through said entry passage at sonic velocities into said expanding passage for acceleration to supersonic velocities.

* * * * *